United States Patent [19]

McKinney

[11] 4,277,839

[45] Jul. 7, 1981

[54] TRANSDUCER ARRAY RELEASE AND PRESSURE COMPENSATION SYSTEM

[75] Inventor: James A. McKinney, Fort Wayne, Ind.

[73] Assignee: The United States of America as represented by the Secretary of the Navy, Washington, D.C.

[21] Appl. No.: 121,550

[22] Filed: Feb. 14, 1980

[51] Int. Cl.[3] ..... H04R 1/44

[52] U.S. Cl. ..... 367/155; 367/165; 367/167

[58] Field of Search ..... 367/3, 4, 165, 172, 367/173, 154, 155, 167

[56] References Cited

U.S. PATENT DOCUMENTS 3,646,505 2/1972 Kirby ..... 367/4

3,803,544 4/1974 Wallen et al. ..... 367/172

*Primary Examiner*—Richard A. Farley

*Attorney, Agent, or Firm*—Richard S. Sciascia; Robert W. Adams; David S. Kalmbaugh

[57] ABSTRACT

A transducer array release and pressure compensation system for releasing a nose cone assembly from a cylindrical housing so as to deploy a plurality of transducer elements and pressure compensate the transducer elements. When hydrostatic pressure is applied to a bladder located within the nose cone assembly, the bladder pulls a release cable so as to release a split ring which secures the nose cone assembly to the cylindrical housing. The application of hydrostatic pressure to the bladder forces air from the nose cone assembly through a compensator airline to the transducer elements so as to pressure compensate the transducer elements.

13 Claims, 4 Drawing Figures

TRANSDUCER ARRAY RELEASE AND PRESSURE COMPENSATION SYSTEM

BACKGROUND OF THE INVENTION

1. Field of the Invention

This invention relates generally to the field of marine engineering. In particular, this invention relates to a release mechanism and pressure control system for a submersible underwater packaged transducer array.

2. Description of the Prior Art

Sonobuoy devices, packaged transducer arrays and the like are widely employed for submarine detection purposes, and are also utilized for underwater geological exploration and other submarine purposes. Sonobuoy devices may be either active, wherein a transmitted signal is produced and the reflected signal is received and transmitted, or the sonobuoy may be passive, wherein received signals are sensed and transmitted.

Sonobuoy devices are normally located as desired by aircraft or water craft. Upon the sonobuoy entering the water the components thereof, such as the sound producing and/or receiving transducers, transmitters, damping means, and other conventional components are deployed from the casing in order that they might best perform their desired function.

Some sonobuoy constructions utilize a release mechanism which releases the components stored therein upon impact with the surface of the water. Still other sonobuoy constructions utilize a release mechanism which is activated at a predetermined depth by hydrostatic pressure.

While satisfactory for their intended purpose, the aforementioned devices of the prior art ordinarily leave something to be desired, especially from the standpoints of release accuracy, design complexity, and efficiency. In particular, prior art release mechanisms have been unduly sensitive, resulting in premature release, prone to bind and not fully release, and also prone to damage during the drop, resulting in an inoperative sonobuoy.

Also to be noted is that upon being deployed from the casing of the sonobuoy, the components stored therein are subject to fracture or breaking due to hydrostatic pressures.

SUMMARY OF THE INVENTION

The subject invention overcomes some of the disadvantages of the prior art, including those mentioned above, in that it comprises a relatively simple transducer array release and pressure compensation system which is responsive to hydrostatic pressure. Consequently, it is more sensitive which, in turn, makes it more efficient and accurate in its response.

Included in the subject invention is a cylindrical housing, a nose cone assembly in removable engagement with the cylindrical housing, and a split ring having a pair of eyelets adapted to secure the nose cone assembly to the cylindrical housing. Positioned within the nose cone assembly is a bladder which has attached thereto one end of a release cable, with the opposite end of the release cable passing through the pair of eyelets of the split ring.

Located within the cylindrical housing and secured thereto are a plurality of transducer elements, each of which has an inlet port connected to an outlet port of the nose cone assembly.

Hydrostatic pressure, when applied to the bladder of the nose cone assembly, causes the release cable to be removed from the split ring, thereby releasing the nose cone assembly from the cylindrical housing so as to deploy the transducer elements. In addition, hydrostatic pressure, when applied to the bladder, forces air from a cavity within the nose cone assembly to the transducer elements so as to pressure compensate the transducer elements.

DESCRIPTION OF THE PREFERRED EMBODIMENT

Figure 1:
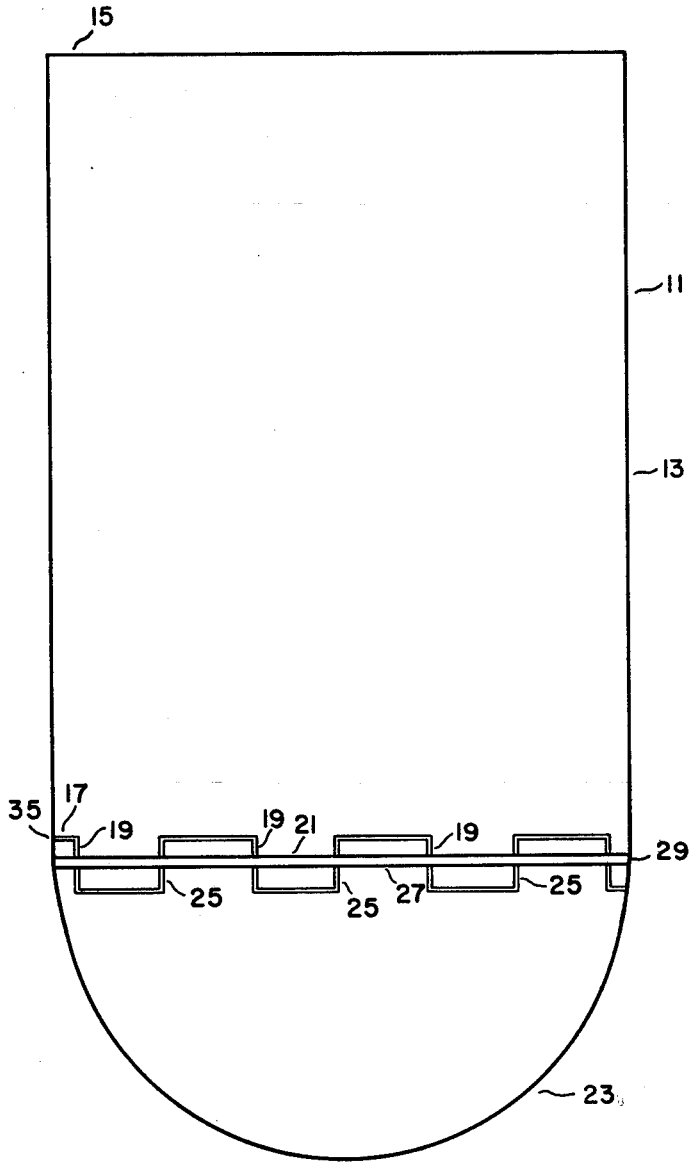
FIG. 1 is a planned view of the subject invention.

The preferred embodiment of the subject invention will now be discussed in some detail in conjunction with all of the figures of the drawings, wherein like parts are designated by like reference numerals, insofar as it is possible and practical to do so.

Referring now to FIG. 1, there is shown a packaged transducer array 11 comprising a cylindrical housing 13 having a closed upper end 15 and an open lower end 17. Lower end 17 of cylindrical housing 13 has located thereon a plurality of teeth 19, each of which has therein a groove 21. Removably coupled to cylindrical housing 13 is a nose cone assembly 23 which has a plurality of teeth 25 in interlocking removable engagement with teeth 19 of cylindrical housing 13. Each tooth 25 of nose cone assembly 23 has a groove 27 located therein such that grooves 27 are in alignment with grooves 21 when nose cone assembly 23 is coupled to cylindrical housing 13.

Figure 4:
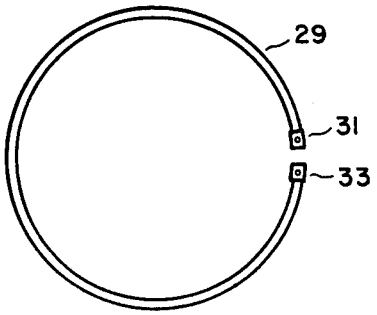
FIG. 4 illustrates the split ring of FIG. 1.

Fitted within grooves 21 of cylindrical housing 13 and grooves 27 of nose cone assembly 23 is a split ring 29 which secures nose cone assembly 23 to cylindrical housing 13. Split ring 29 has located on one end thereof an eyelet 31, FIG. 4, and on the opposite end thereof an eyelet 33, FIG. 4.

At this time it may be noteworthy to mention that split ring 29 may be any conventional corrosion resistant high tensile sprung steel ring and is commercially available from several different sources.

Located between teeth 19 of cylindrical housing 13 and teeth 25 of nose cone assembly 23 is a gap 35 which allows a liquid, such as water, to flow therethrough to the inside of packaged transducer array 11.

Figure 2:
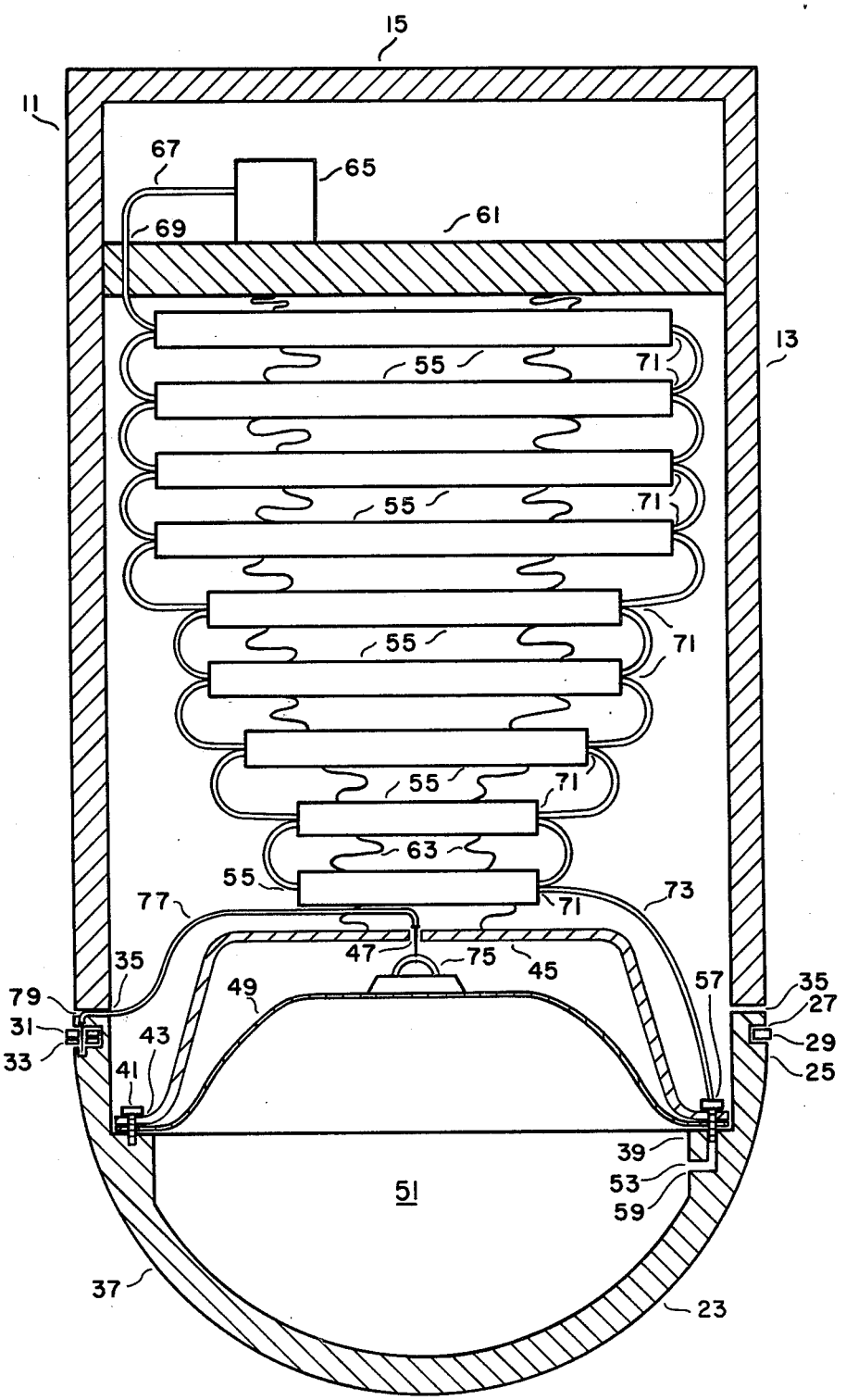
FIG. 2 is a sectional view showing the invention of FIG. 1 in its storage and deployment package.

Referring now to FIG. 2, there is shown nose cone assembly 23 which includes a nose cone 37. Nose cone 37 has on the inner surface near the upper portion thereof a shoulder 39. Mounted upon shoulder 39, as by a plurality of bolts 41, is an annular flange 43 of a bladder housing 45. Bladder housing 45 has an aperture 47 in the center thereof, and may be fabricated from any light weight porous material including, for example, fiberglass.

A bladder 49 is secured to the inside of nose cone assembly 23 between annular flange 43 of bladder housing 45 and shoulder 39 so as to form an airtight cavity 51 within nose cone assembly 23. Airtight cavity 51 may be filled with any compressible medium, including but not limited to air, at an aperture 53 which passes through shoulder 39 of nose cone 37 and annular flange 43 of bladder housing 45. The specific pressure in airtight cavity 51 is set at 14.7 pounds per square inch so as to stabilize the pressure within a plurality of transducer elements 55 located in cylindrical housing 13, as will be explained more fully below.

At this time it may be noteworthy to mention that bladder 49 may be fabricated from any nonporous flexible material including, for example, a rubberized compound.

Inserted in aperture 53 at one end thereof is a threaded orifice 57 which with aperture 53 forms an outlet port 59 for airtight cavity 51.

Located within the upper portion of cylindrical housing 13 and affixed thereto in substantial parallel alignment with closed upper end 15 of cylindrical housing 13 is a support member 61. Four equally spaced support cables 63 are connected at one end thereof to the bottom surface of support member 61, with the remainder of equally spaced support cables 63 effectively connected to transducer elements 55.

Mounted upon the upper surface of support member 61 is a power source 65, the output of which is connected to the inputs of transducer elements 55 by a power cable 67 which passes through an aperture 69 located in support member 61.

Outlet port 59 of nose cone assembly 23 is effectively connected to each inlet port 71 of transducer elements 55 by a compensator airline 73.

At this time it would perhaps be noteworthy to mention that each transducer element 55 comprises a dish shaped aluminum shell, not shown, with a piezo interior, not shown. Centrally located within the piezo interior of each transducer element 55 is a cavity, not shown, which is connected to compensator airline 73 by inlet port 71.

Fixedly attached to the upper surface of bladder 49 is a handle 75. Connected to handle 75 is a release cable 77. Release cable 77 then passes through aperture 47 centrally located within bladder housing 45, gap 35, an aperture 79 located within nose cone assembly 23, and eyelets 31 and 33 of split ring 29.

The operation of the subject invention will now be discussed in conjunction with all of the figures of the drawings.

Referring now to FIGS. 1 and 2, a liquid, such as water, enters the interior of packaged transducer array 11 through gap 35 so as to fill the interior of cylindrical housing 13 with the liquid.

The liquid then passes from the interior of cylindrical housing 13 through bladder housing 45 to the upper surface of bladder 49 so as to cause hydrostatic pressure to be applied thereto. As packaged transducer array 11 descends in the liquid, hydrostatic pressure upon the upper surface of bladder 49 will increase, so as to continue to collapse bladder 49. This, in turn, causes the tension upon release cable 77 to increase until the tension thereon exceeds the static clamping force of split ring 29.

When the tension on release cable 77 exceeds the static clamping force of split ring 29, release cable 77 will be pulled from eyelets 31 and 33 of split ring 29, thereby causing split ring 29 to spring free of packaged transducer array 11. This, in turn, releases nose cone assembly 23 from cylindrical housing 13 such that transducer elements 55 will be deployed in the configuration illustrated in FIG. 3.

Figure 3:
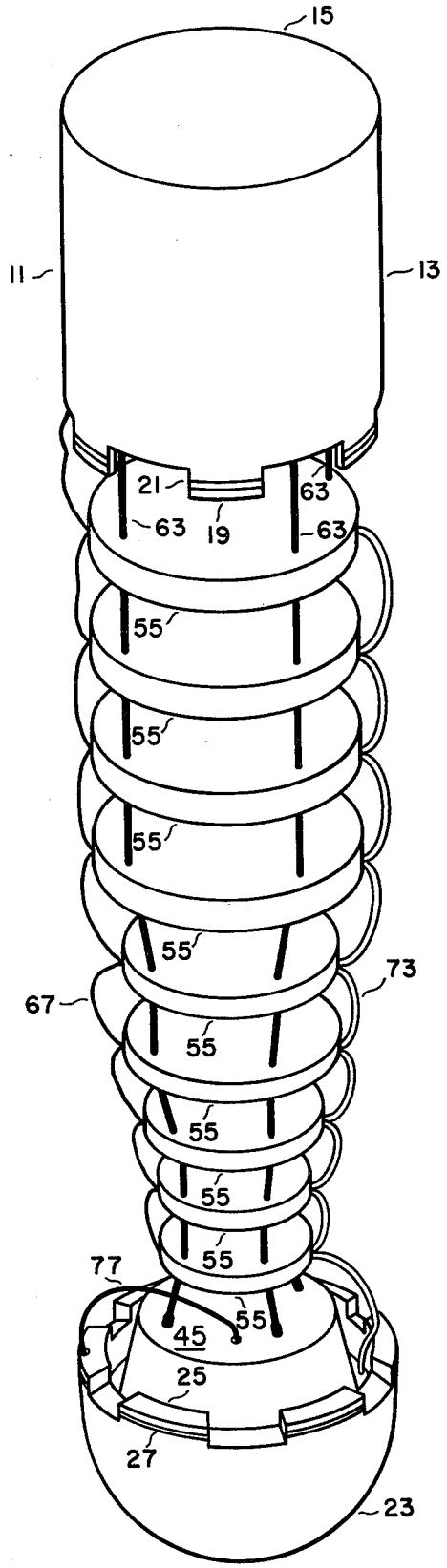
FIG. 3 illustrates the invention of FIG. 1 when fully developed.

When packaged transducer array 11 is deployed as illustrated in FIG. 3, packaged transducer array 11 becomes fully operational so as to allow transducer elements 55 to emit therefrom sound waves to be transmitted through the liquid.

As mentioned above, when packaged transducer array 11 descends in the liquid, hydrostatic pressure upon the upper surface of bladder 49 will increase so as to collapse bladder 49, thus forcing air from cavity 51 through compensator airline 73 to the cavity, not shown, within each transducer element 55. This, in turn, pressure compensates transducer elements 55 so as to prevent the fracturing thereof due to hydrostatic pressure.

From the foregoing, it may be seen that the subject invention comprises a new, unique, and exceedingly useful transducer array release and pressure compensation system which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

I claim:

1. A transducer array release and pressure compensation system comprising in combination:

a cylindrical housing having a permanently closed upper end and an open lower end, the lower end of said cylindrical housing having a plurality of teeth, each of which has located therein a groove;

a nose cone assembly having an outlet port, and a plurality of teeth in interlocking removable engagement with the teeth of said cylindrical housing, each tooth of said nose cone assembly having a groove therein in substantial alignment with the grooves of the teeth of said cylindrical housing;

signal sending means positioned within said cylindrical housing, said signal sending means having a plurality of inlet ports effectively connected to the outlet port of said nose cone assembly for transmitting through a liquid a plurality of sound waves;

pressure compensating means located within said nose cone assembly and secured thereto for varying the air pressure within said signal sending means when hydrostatic pressure is applied to said pressure compensating means so as to prevent the fracturing of said signal sending means when hydrostatic pressure is applied thereto; and securing means adapted to fit within the grooves of the teeth of said nose cone assembly and said cylindrical housing, and effectively connected to said pressure compensating means for releasing said nose cone assembly from said cylindrical housing when hydrostatic pressure is applied to said pressure compensating means.

2. The transducer array release assembly and pressure compensation system according to claim 1, wherein said nose cone assembly comprises:

a nose cone having a plurality of teeth in removable interlocking engagement with the teeth of said cylindrical housing and a shoulder located near the upper portion thereof, the shoulder of said nose cone having an aperture passing therethrough, and a bladder housing having an annular flange mounted upon the shoulder of said nose cone, and annular flange having an aperture in substantial alignment with the aperture of the shoulder of said nose cone.

3. The transducer array release assembly and pressure compensation system according to claim 2, wherein said bladder housing is fabricated of a light weight porous material.

4. The transducer array release assembly and pressure compensation system according to claim 1, wherein said signal sending means comprises:

a power source having an output;

a plurality of transducer elements each of which has an input connected to the output of said power source, and each of which has an inlet port;

a compensator airline effectively connected between the outlet port of said nose cone assembly and the inlet ports of said plurality of transducer elements; and a quartet of equally spaced support cables, each of which has one end thereof connected to the upper portion of said cylindrical housing and each of which has the remainder thereof effectively connected to said plurality of transducer elements.

5. The transducer array release assembly and pressure compensation system according to claim 4, wherein said plurality of transducer elements comprises nine transducer elements.

6. The transducer array release assembly and pressure compensation system according to claim 1, wherein said pressure compensating means comprises a bladder.

7. The transducer array release assembly and pressure compensation system according to claim 1, wherein said securing means comprises:

a split ring adapted to fit within the grooves of the teeth of said nose cone assembly and said cylindrical housing, said split ring having at one end thereof a first eyelet and at the opposite end thereof a second eyelet; and a release cable attached at one end thereof to said pressure compensating means and with the opposite end thereof passing through the first and second eyelets of said split ring.

8. A transducer array comprising in combination:

a cylindrical housing having a permanently closed upper end and an open lower end, the lower end of said cylindrical housing having a plurality of teeth, each of which has located therein a groove;

a nose cone assembly having an outlet port and a plurality of teeth, each of which has located therein a groove, the teeth of said nose cone assembly being in interlocking removable engagement with the teeth of said cylindrical housing such that the grooves thereof are in substantial alignment;

a split ring adapted to fit within the grooves of the teeth of said nose cone assembly and said cylindrical housing so as to secure said nose cone assembly to said cylindrical housing, said split ring having at one end thereof a first eyelet and at the opposite end thereof a second eyelet;

a bladder located within the upper portion of said nose cone assembly and secured thereto;

a release cable attached at one end thereof to said bladder and with the opposite end thereof passing through the first and second eyelets of said split ring such that application of hydrostatic pressure to the upper surface of said bladder causes the removal of said release cable from the first and second eyelets of said split ring so as to release said nose cone assembly from said cylindrical housing;

a plurality of transducer elements, each of which has an inlet port and an input, said plurality of transducer elements being located within said cylindrical housing; and a compensator airline effectively connected to the outlet port of said nose cone assembly at one end thereof, with the remainder of said compensator airline effectively connected to the inlet ports of each of said plurality of transducer elements.

9. The transducer array according to claim 8, wherein said nose cone assembly comprises:

a nose cone having a plurality of teeth in removable interlocking engagement with the teeth of said cylindrical housing, and a shoulder located near the upper portion thereof, the shoulder of said nose cone having an aperture passing therethrough; and a bladder housing having an annular flange mounted upon the shoulder of said nose cone, said annular flange having an aperture passing therethrough in substantial alignment with the aperture of said nose cone.

10. The transducer array according to claim 9, wherein said bladder housing is fabricated of a light weight porous material.

11. The transducer array according to claim 8, wherein the outlet port of said nose cone assembly comprises:

an aperture passing through said nose cone assembly; and a threaded orifice having one end thereof inserted in the aperture of said nose cone assembly with the opposite end thereof effectively connected to the inlet ports of said plurality of transducer elements.

12. The transducer array according to claim 8, further characterized by a power source having an output effectively connected to the inputs of said plurality of transducer elements.

13. The transducer array according to claim 8, further characterized by four equally spaced support cables, each of which has one end thereof connected to the upper portion of said cylindrical housing and each of which has the remainder thereof effectively connected to said plurality of transducer elements.

* * * * *